United States Patent [19]

Steiner et al.

[11] 4,002,189

[45] Jan. 11, 1977

[54] APPARATUS FOR SELECTING SHUTTLES WITH WEFT WINDINGS OF DIFFERENT YARN TYPES

[75] Inventors: Alois Steiner, Rieden; Edgar Strauss, Ruti, both of Switzerland

[73] Assignee: Ruti Machinery Works Ltd., Ruti, Switzerland

[22] Filed: Aug. 11, 1975

[21] Appl. No.: 603,515

[30] Foreign Application Priority Data

Aug. 26, 1974 Switzerland ..... 11608/74

[52] U.S. Cl. ..... 139/436; 139/224 R

[51] Int. Cl.[2] ..... D03D 47/26; D03D 45/00

[58] Field of Search ..... 139/12, 13, 224 R, 224 A, 139/126, 125, 122 W, 436

[56] References Cited

UNITED STATES PATENTS

| | | | |
|---|---|---|---|
| 720,181 | 2/1903 | Salisbury | 139/12 |
| 1,161,979 | 11/1915 | Salisbury | 139/12 |
| 2,609,008 | 9/1952 | Cooper | 139/224 R |
| 2,684,084 | 7/1954 | Cooper | 139/224 R |
| 3,263,705 | 8/1966 | Rossmann | 139/12 |

FOREIGN PATENTS OR APPLICATIONS

| | | | |
|---|---|---|---|
| 2,118,445 | 11/1971 | Germany | 139/12 |
| 2,116,845 | 9/1972 | Germany | 139/436 |

*Primary Examiner*—James Kee Chi

*Attorney, Agent, or Firm*—Donald D. Denton

[57] ABSTRACT

The present invention covers an apparatus for selecting shuttles having weft windings therein of different filling yarn types for preprogrammed weft insertions on a wave-type or corrugated shed loom.

12 Claims, 7 Drawing Figures

31
30
31a
15
28
29
21a
21b
21c
21d
41a
41b
41c
41d
48
60
59
58
57
54
53
52
51
25
26
24
23
22
44
43
45
42

APPARATUS FOR SELECTING SHUTTLES WITH WEFT WINDINGS OF DIFFERENT YARN TYPES

BACKGROUND OF THE INVENTION

The present invention relates to an apparatus for selecting shuttles with weft windings of different filling yarn types for preprogrammed weft insertions on a corrugated shed or travelling wave-type loom, whereby the shuttles involved in the weaving process receive their winding through a winding mechanism.

For a multi-type, particularly multi-colored, operation in the weft of a corrugated shed loom, hitherto only a multiple storage devide for storing a plurality of shuttles prepared for weft insertion has been proposed. This multiple storage device comprises a plurality of magazines whereby each magazine serves to store shuttles with windings of the same yarn type.

However, such a multiple storage device is very difficult to realize because considerable conveying and control problems result from a removal of the individual shuttles from the magazine and their introduction into the weaving process in the correct sequence and at a speed synchronous with the weaving process.

SUMMARY OF THE INVENTION

The present invention overcomes such problems and provides an apparatus of the type indicated hereinbefore, which ensures a multi-type or multi-colored insertion operation in the weft of a corrugated shed loom with relatively simple means.

According to the invention, this problem is solved in that the apparatus comprises a plurality of stations each with a winding mechanism therein arranged in the weft insertion zone of the corrugated shed loom, whereby control members at each station are linked with a programme control device for selective introduction of the shuttles prepared in the winding mechanisms of the stations into the weaving process and for the, at least approxmately, simultaneous removal of an empty shuttle from the movement paths of the shuttles and its supply to the appropriate winding mechanism.

In maintaining the fundamental principle of supplying a corrugated shed loom with shuttles carrying weft windings, these measures now make it possible to limit the control function synchronous with the weaving process to the selection of the particular station of the selection apparatus, which from a control standpoint represents a considerable simplification. Furthermore as a result of the direct replacement of an empty shuttle for a shuttle carrying winding, a multiple storage of shuttles with windings of one and the same yarn type becomes superfluous, making magazines and storage means unnecessary, and thus the number of shuttles necessary can be considerably reduced.

Advantageously, the arrangement can be such that the empty shuttles when removed from the weaving process are received by a discharge box and can be transferred by the latter to the winding mechanism, whereby at least approximately simultaneously a slide introduces into the weaving process the prepared shuttle at the particular winding mechanism.

In this connection it is necessary that, after removing the prepared shuttle from the winding mechanism by the slide and prior to the transfer of the empty shuttle through the discharge box to the winding mechanism, the latter must convey a new winding into the transfer area of the winding mechanism for the purpose of transferring this winding to the empty shuttle.

BRIEF DESCRIPTION OF THE DRAWINGS

These and other objects of the present invention will become apparent from the following description and claims and are illustrated in the accompanying drawings which by way of illustration show preferred embodiments of the present invention and the principles thereof and what are now considered to be the best modes contemplated for applying these principles. In the drawings:

DESCRIPTION OF THE PREFERRED EMBODIMENTS

Figure 1:
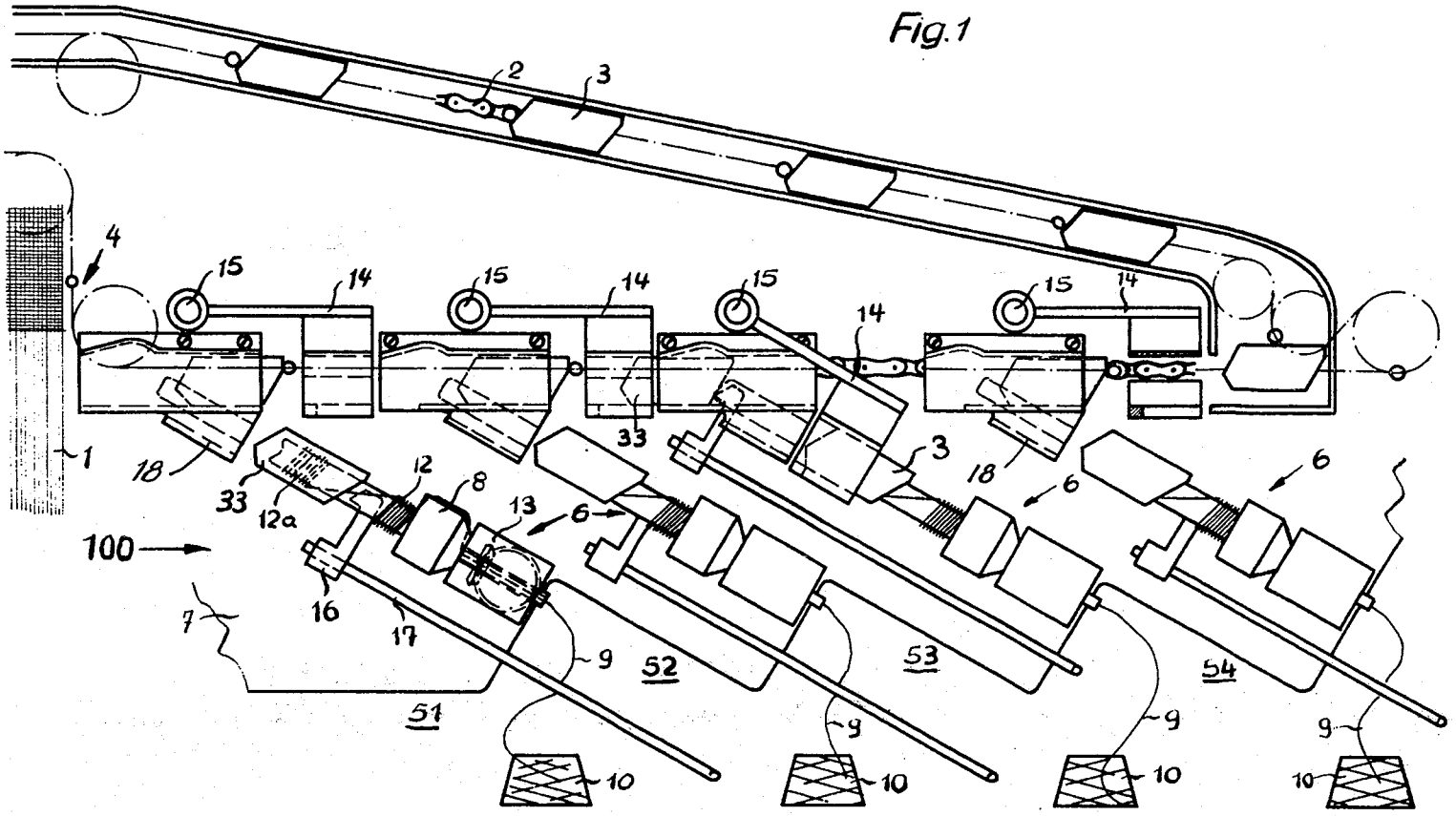
FIG. 1 shows a cutaway schematic front view of a corrugated shed loom with an apparatus for selecting shuttles for weft insertion.
Figure 2:
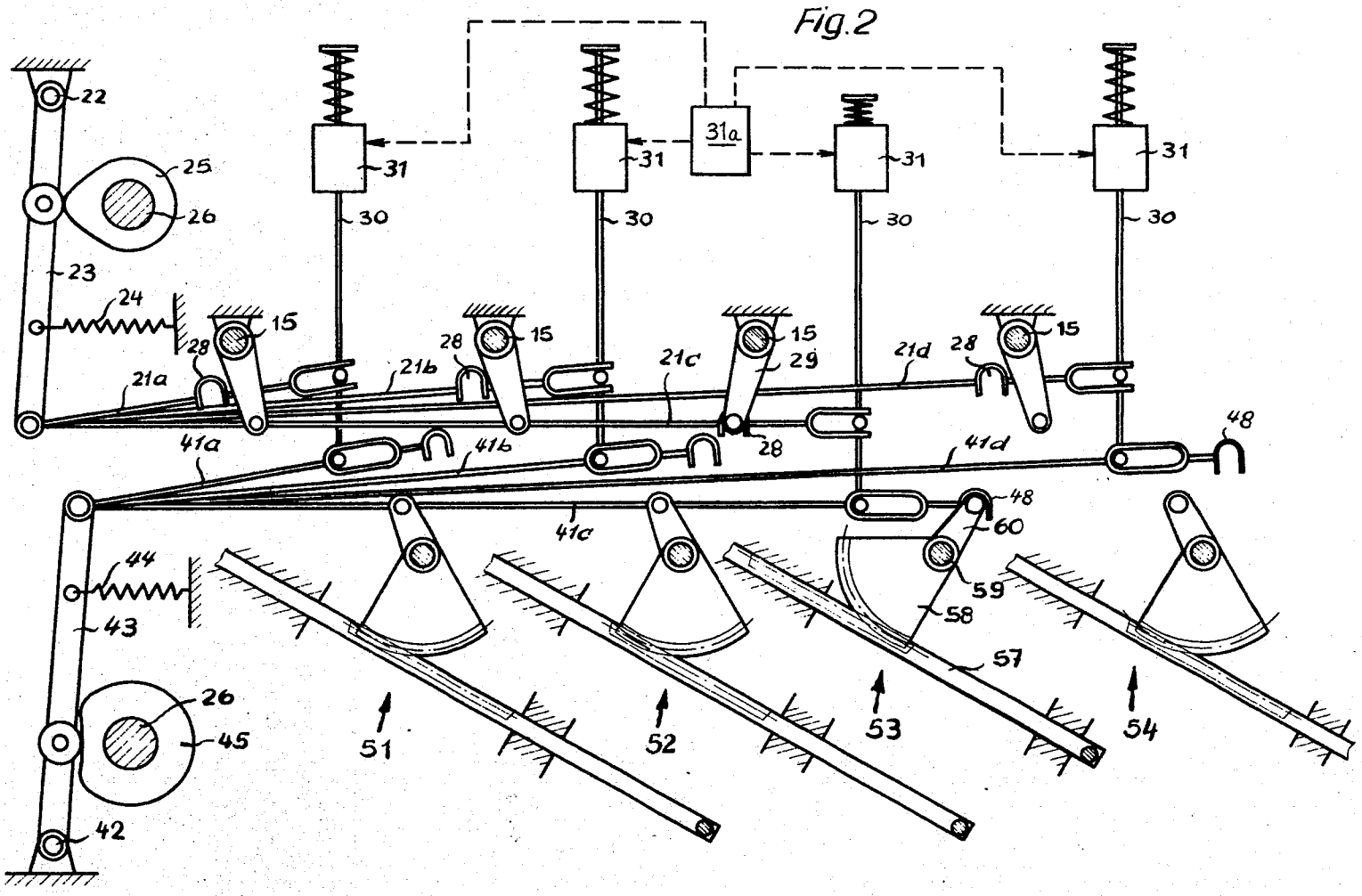
FIG. 2 shows a control member for the operating of the apparatus according to FIG. 1.

In the apparatus for selecting shuttles with weft windings of different filling yarn types, for example of different color, for a preprogrammed weft insertion to a traveling wave or corrugated shed loom shown in FIGS. 1 and 2, the corrugated shed loom is indicated by the edge of the fabric 1, where weft insertion commences, and by a conveyor chain 2. The conveyor chain 2 in known manner returns empty shuttles 3 which participated in the weaving process from the discharge side of the fabric (not shown) to the feed side at edge of fabric 1. In front of the feed side is located a selection apparatus 100 in which the empty shuttles 3 are continually exchanged for shuttles 33 with a weft winding therein for providing the weft insertion, in the manner to be described hereinafter. In known manner, the full shuttles 33 then arrive at insertion point 4 in the working area of the reed members of the corrugated shed loom controlled in undulatory manner by which they are moved farther into the shed (i.e. toward the left in the drawing), whereby weft insertion takes place. At this point and as indicated by dotted lines, the chain 2 is reoriented and moved past the fabric. This is generally known and requires no further explanation in the present context.

For example, it will be assumed that there is a four-color operation in the weft for which purpose the selection apparatus 100 comprises four so-called stations 51 to 54 which in each case has a winding mechanism 6 supported on a machine frame 7. These stations are arranged in series relative to the direction of movement of the shuttles towards the shed, adjacent to insertion point 4.

Each winding mechanism 6 can for example have a construction of the type described in detail in Swiss Patent No. 457,315 assigned to the assignee of the subject invention, and the parent of the U.S. Pat. No.

3,519,025 and also illustrated in U.S. Pat. Nos. 3,742,986; 3,672,404; and 3,809,129. Thus, each such winding mechanism comprises a rotor 8, which receives a thread 9 from a bobbin 10 and which on a so-called blade 11 produces a thread winding 12 of given length. An electro magnetic clutch 13 cooperates with the rotor and in a manner not described in greater detail here makes it possible to connect the rotor 8, as desired, with a rotary driving shaft in accordance with requirements to be explained in greater detail hereinafter.

In operation, rotor 8 places turns around blade 11 until winding 12 is formed which is then moved into a transfer position (towards the left in the drawing) by not shown means on blade 11. The weft winding 12*a* in the transfer position is indicated at the left-hand station 51 in the drawing.

In known manner an empty shuttle 3 can now be slipped over this weft winding 12*a* in the transfer position so that shuttle 3 transfers a weft winding and this shuttle is now in the position of readiness for introduction into the weaving process. The first two stations 51 and 52 and the final station 54, from left to right show this position of readiness, whereas in the case of the third station 53 the insertion of the prepared shuttle 33 with a winding therein is being carried into the weaving process as shown. Also, this station shows the removal of an empty shuttle from the weaving process and its transfer to the particular winding mechanism.

For removing the empty shuttle 3 from the weaving process and its transfer to the particular winding mechanism 6 each station has a preferably fork-shaped discharge box 14 whose operation approximately corresponds to that of the discharge box according to Swiss Pat. No. 457,315 set forth above. In its inoperative position the discharge box 14 extends beyond the movement path of the empty shuttle 3 and can be swivelled or pivoted about its swivel or pivot pin 15 through the movement path of the empty shuttle 3 relative to blade 11. During this movement the discharge box 14 takes up an empty shuttle 3 from the conveyor chain 2 and presses this over the blade 11 of the particular winding mechanism 6, as a result of which the shuttle receives its new winding and therefore presents itself in its new position of readiness as a shuttle 33 with a winding therein. This pivotal movement of discharge box 14 is shown relative to the third station 53 in FIG. 1.

A slide 16 moves such a shuttle 33 from its position of readiness into a drive gap of conveyor chain 2 which by means of a driving rod 17 can be brought from its inoperative position into its operative position shown at the third station 53, whereby filled shuttle 33 slides from blade 11 via an inclined channel 18 into the movement path of the chain.

The removal of an empty shuttle 3 from the weaving process; the insertion of the shuttle 33 containing weft thread prepared at the particular station into the weaving process, appropriately in the drive gap of conveyor chain 2 which has become available; the movement of winding 12 on blade 11 into the position of readiness; the slipping of the empty shuttle 3 over the prepared winding 12*a* bringing about its position of readiness as a new shuttle as well as the production of a new winding on blade 11, are all dependent on an accurately predetermined movement sequence in accordance with a programme control device 31*a* and as a function of the speed of the weaving process.

In a manner to be described in greater detail hereinafter relative to these processes, the control members cooperate with the individual stations which are in working connection by being operatively connected both with the main shaft of the machine and with a generally electronic programme control device. These control members are particularly shown in FIG. 2.

Connecting rods 21*a* to 21*d* of differing length corresponding to the distance between the individual stations 51 to 54 from the introduction point 4 of the shed of the loom serve to perform the predetermined pivotal movement of discharge box 14 of each station 51 to 54 synchronously with the rotary movement of the main shaft of the loom. These connecting rods are jointly articulated to a lever 23 which pivots about a shaft 22, whereby the lever engages on a first adjusting cam 25 on a shaft 26 counter to the action of a spring 24. Each of these connecting rods can be brought into operative connection as desired with a particular discharge box 14 by means of a latch connection 28 and a lever 29 which pivots on the pin 15 of each discharge box 14, as shown relative to station 53. For this purpose the free ends of the connecting rods each engages on a control rod 30 which, depending on its position, makes or breaks the operative connection between the connecting rod and the appropriate discharge box. By means of these control rods 30 the actuation of the discharge boxes 14 can be initiated in accordance with the weaving programme, for which purpose the rods 30 cooperate for example with electro magnetic actuating devices 31 receiving their signals from the programme control device 31*a*.

Further connecting rods 41*a* to 41*d* corresponding approximately with connecting rods 21*a* and 21*d* are provided at each station 51 to 54 for the synchronous movement of slide 16 or its driving rod 17 with the rotary movement of the main machine shaft. These connecting rods 41*a* and 41*d* are jointly articulated to a further lever which pivots about a shaft 42 and which engages on a second adjusting cam 45 on shaft 26 counter to the action of a spring 44. Each of these connecting rods 41*a* to 41*d* can also be brought into operative connection, as desired, with the particular slide or its driving rod 17 via a latch connection 48, as shown once again by station 53. To this end once again each of the connecting rods 41*a* to 41*d* engage on the said control rod 30 of the particular station. FIG. 2 of the drawing shows that the coupling between one of the connecting rods 21*a* to 21*d* with the particular discharge box 14 of the control station takes place simultaneously with the coupling between one of the connecting rods 41*a* to 41*d* with the particular slide 16 of the same station jointly by means of the same magnetic control mechanism 30, 31. The necessary phase displacement between the movement sequence of slide 16 and discharge box 14 is brought about by the construction of faces of the cams 45 or 25.

As the drawing shows, the said connecting rods 41*a* and 41*d* do not engage directly on the driving rods 17 associated therewith. In each case a rack, which is for example parallel, is associated with the driving rods 17, whereby the particular driving rod 17 is connected with the rack 57 by not shown means. A toothed segment 58 cooperates with each rack 57, whereby the said toothed segment pivots about a setment pivoting shaft 59 and which, with the free lever end 60, is latchable with the particular connecting rod 41*a* to 41*d*, as illustrated by station 53.

In accordance with a repeat pattern for the sequence on the corrugated shed loom, which for example requires a weft from station 53, hereinafter the operation of the above-described apparatus will be explained. Initially there is based on an operating phase where a shuttle 33 with a weft winding 12*a* therein is positioned in readiness on each blade 11. Furthermore each blade 11 carries a finished reserve winding 12, each rotor 8 is stationary through its open clutch 13, and all control rods 30 are disengaged relative to connecting rods 21*a* to 21*d* or 41*a* to 41*d*.

In this phase, all the connecting rods perform on "empty" to and fro movement at the speed of the machine. Naturally this to and fro movement corresponds to the spacing and running speed of the shuttles participating in the weaving process. When an empty shuttle 3 reaches station 53, the control magnet 31 of this station receives a signal from the programme control device 31*a* so that control rod 30 is forced downwards, so that both connecting rod 21*c* and control rod 41*c* are also pivoted downwards from their no-load stroke position into an operating stroke position. Thus, connecting rod 21*c* via its latch means 28 and lever 29 passes into operative connection with the particular discharge box 14 of station 53. Furthermore, connecting rod 41*c* via its latch means 48 and via control means 57 to 60 is brought into operative connection with slide 16.

Through the corresponding construction of cams 25 and 45 as well as the corresponding and at least partly oppositely directed displacement sequence on the participating connecting rods 21*c* and 41*c*, the discharge box 14 is initially pivoted downwards towards the empty shuttle which has entered station 53 and slide 16 is pushed forwards carrying along the prepared shuttle 33 on blade 11 of the particular station 53. In the represented arrangement the discharge box 14 initially removes shuttle 3 from conveyor chain 2 and thus leaves a gap 3 into which the slide 16 forces the full shuttle 33. Before in its remaining path discharge box 14 presses the empty shuttle onto blade 11, the winding mechanism 6 must in the meantime have at least pushed reserve winding 12 forwards into the position of readiness 12*a* in order to produce a new reserve winding 12. For this process the electro magnetic clutch 13 of the winding mechanism can receive a signal from the programme control device 31*a* or slide 16 can in its displacement path close a contact in the exciter circuit for the electro magnetic clutch 13. All these processes take place very rapidly so that discharge box 14 can continue its pivotal movement substantially without any delay and force the carried-along empty shuttle 3 onto the already forwardly moved winding 12*a*. All the members participating in the above-described process return to their starting position in a sequential movement and once again a shuttle 33 with a winding is located in the position of readiness on the blade 11 of station 53, so that, if so required by the repeat pattern, the same station can immediately be selected again.

FIGS. 3 to 7 show another embodiment of an apparatus for selecting shuttles with weft windings of different yarn types and specifically on a corrugated shed loom, where the conveyance of the filled shuttle to the insertion point no longer takes place by means of the shuttle conveyor chain but instead by a different insertion means located outside the chain path.

In this embodiment once again four stations 51 to 54 are provided which are now juxtaposed in star-like manner relative to insertion point 4 (FIG. 4) of the shuttles into the shed of the corrugated shed loom and namely in front of the said position 4. The star-like arrangement can be seen in FIGS. 3, 6, and 7.

Figure 3:
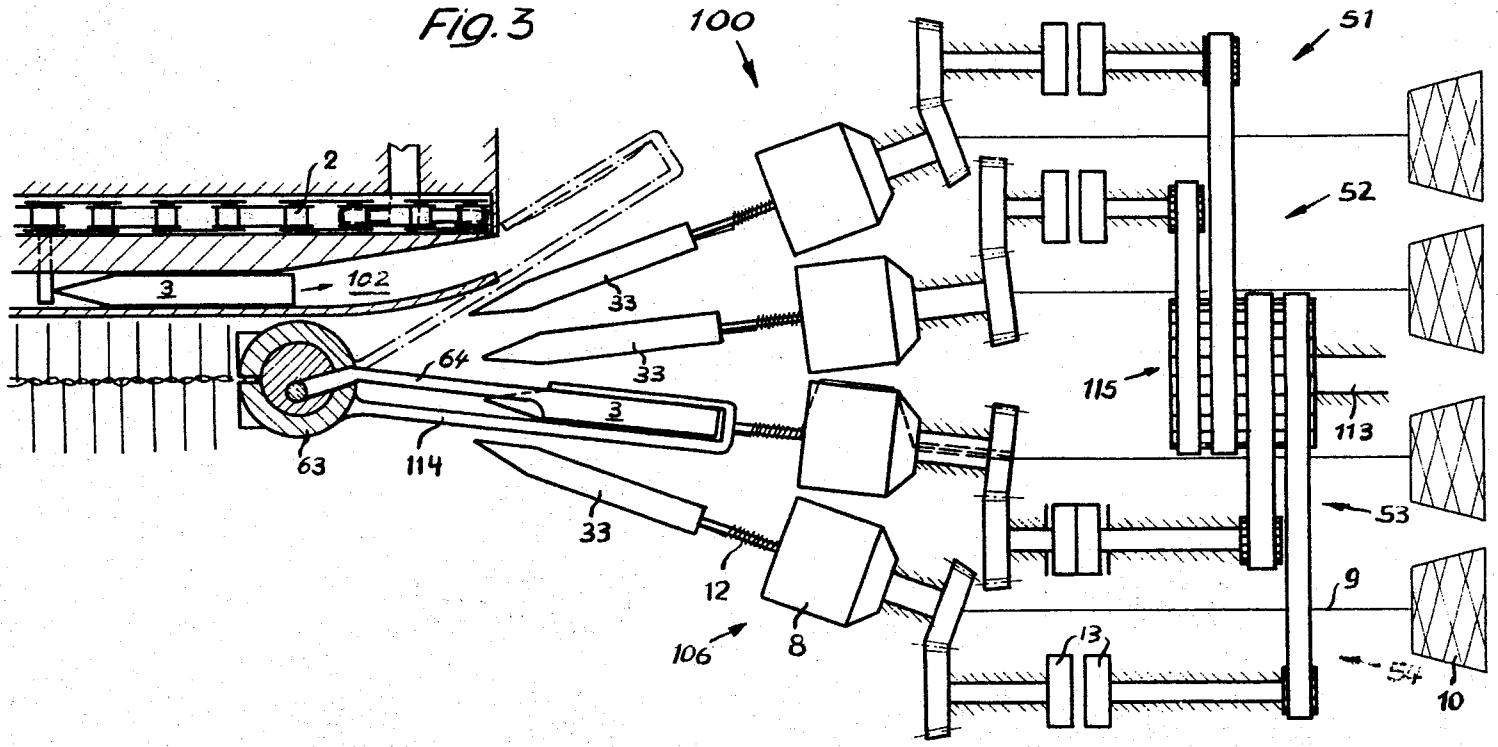
FIG. 3 shows a schematic cutaway plan view of a corrugated shed loom with a different construction having a variant apparatus for selecting shuttles for weft insertion.

As is clearly shown in FIG. 3, the empty shuttles 3 conveyed back from the discharge side of the shed to the insertion side by means of a conveyor chain 2 in a channel 102 are taken over by the selection apparatus or mechanism 100. In like manner clearly shown in FIGS. 4 and 7, the shuttles 33 provided with a winding are passed directly from this selection apparatus via insertion members located outside the conveyor chain 2 into the shed, these insertion members comprise a driven roller 70 and a spring biased counter-roller 71, which move the shuttles into the shed, as will be explained hereinafter.

A transfer point of the empty shuttle 3 on the selection apparatus 100 is located adjacent to station 51 in a common swivel zone relative to one fulcrum for all the stations 51 to 54, at which point the incoming shuttle 3 moves into a discharge box 114 common to all the stations 51 to 54 (FIG. 3). This fulcrum is formed by a rotary pin 63 with which the discharge box 114 is fixedly connected. A pusher 64 in discharge box 114 extends through a slot 65 into the rotary pin 63, whereby a plunger 66 is connected with pusher 64 which coaxially penetrates pin 63 and carrying on its top a scanning head 67 which is so pretensioned by a not shown spring that the pusher 64 assumes an upper normal position where a shuttle 3 can pass into the discharge box 114. In the upper area of pin 63 a further guidance slot 68 is provided into which extends a fork 69 which is connected in rotation-proof manner with pin 63 but can move axially relative thereto. A further coaxial plunger 80 cooperates with fork 69 which also carries a scanning head 81 at its free end and is so pretensioned by a spring 82 that the fork 69 assumes an upper normal position as will be explained in greater detail hereinafter. The arrangement is such that the two plungers 66 and 80 which penetrate pin 63 are so juxtaposed that their scanning head 67 or 81 in any angular position of pin 63 remain under the scanning surface of a fixed control member to be described in greater detail hereinafter. As shown in particular in FIG. 3, by rotary pin 63 discharge box 114 can be pivoted out of its shuttle removal position shown by dotted lines into the operating zone of one of the stations 51 to 54, as indicated at station 53.

As set forth in the previously described first embodiment, each station 51 to 54 comprises a winding mechanism 106 having at least approximately the same construction as the winding mechanism 6 in FIG. 1 and 2. As shown particularly by FIGS. 3 and 4, each winding mechanism 106 has a rotor 8 to which a thread 9 is supplied from a bobbin 10 and which on a blade 11 produces a thread winding 12 of given length. An electromagnetic clutch cooperates with rotor 8 permitting the rotor 8 to be connected as desired with a rotary driving shaft 113 via gear means 115, corresponding to requirements to be explained in greater detail hereinafter.

Figure 4:
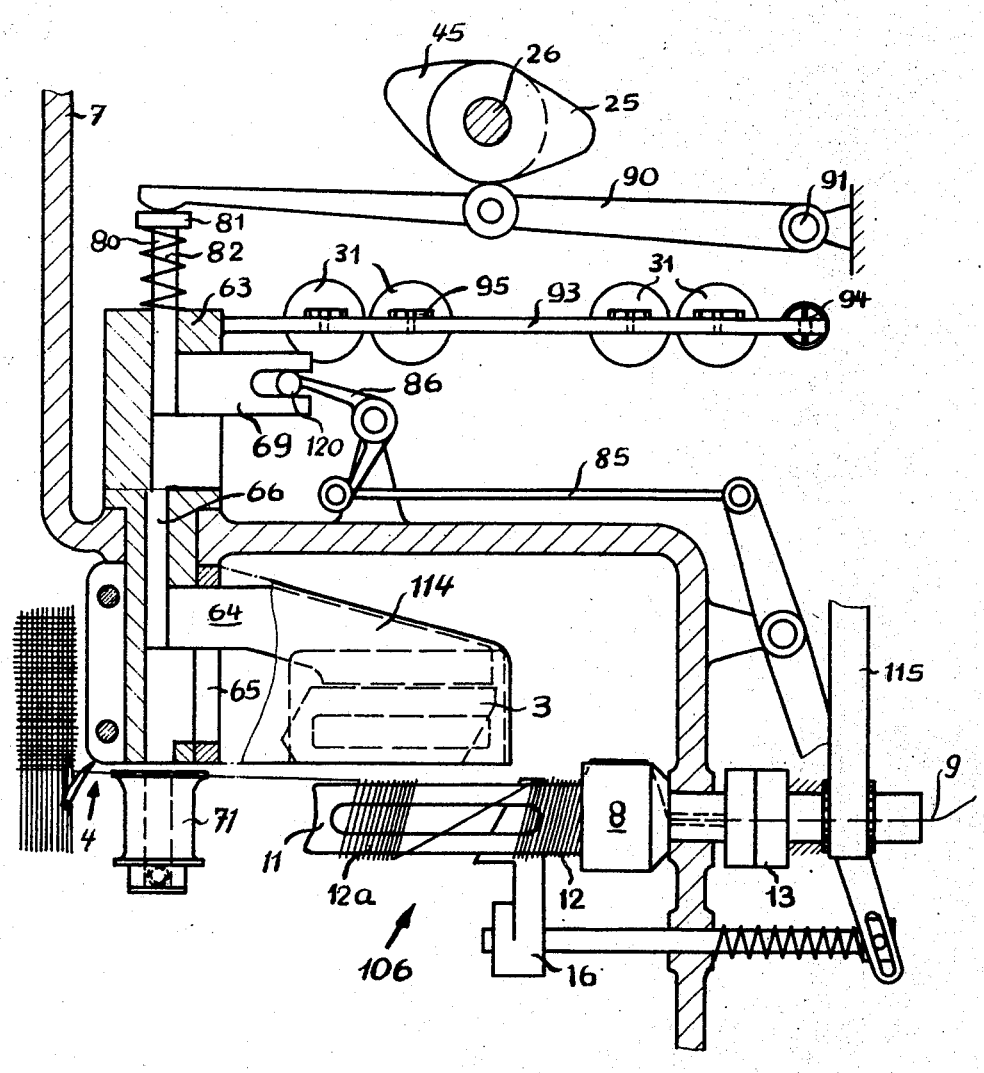
FIG. 4 shows a side view in detail of the selection portion of the apparatus presented in FIG. 3.

In operation, rotor 8 places thread turns around blade 11 until winding 12 is formed. Winding 12 is then moved (to the left in the drawing) by not shown means on blade 11 into a transfer position. The weft winding 12*a* is then in the transfer position as shown in FIG. 4.

An empty shuttle 3 is now slid over the weft winding 12*a* in the transfer position, whereby shuttle 3 receives a weft winding and is now in a position of readiness for insertion into the weaving process. As already indicated hereinbefore, discharge box 114 receives an empty shuttle 3 and is pivoted therewith over the blade 11 of the particular station. On operating plunger 66 the pusher 64 in discharge box 114 is briefly moved downwards pressing the empty shuttle 3 onto the blade 11 with the windings 12*a*.

Figure 6:
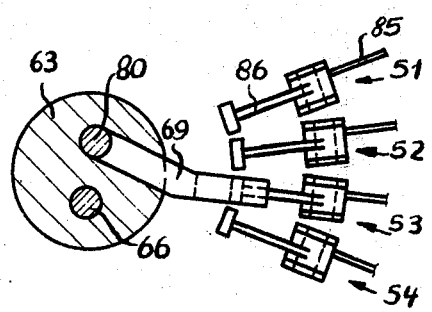
FIG. 6 shows a schematic view in detail of the arrangement presented in FIG. 3.
Figure 7:
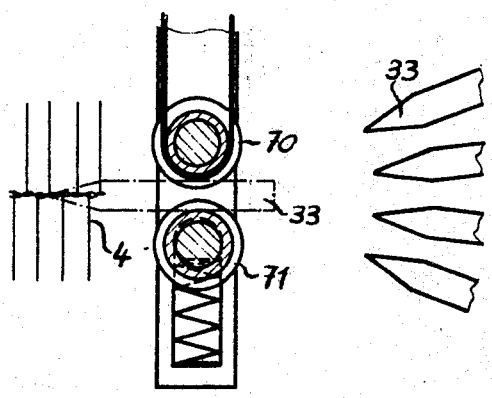
FIG. 7 shows a further schematic view in detail of the arrangement presented in FIG. 3.

A shuttle 33 filled with weft winding is moved from its position of readiness into the insertion members 70, 71 by a slide 16 (FIG. 4) associated with each station 51 to 54, which by means of a rod arrangement can be brought from its represented inoperative position into an operative position by operating the above-mentioned fork 69, whereby shuttle 33 passes from blade 11 between insertion members 70, 71 which bring about the further transportation of this shuttle into the shed in known manner. For this purpose the rod system 85 comprises a toggle lever 86, which as a result of an appropriate pivoting of pin 63 and therefore fork 69 with its one end 120 engages into the same, whereupon a downward movement of plunger 80 brings about a feed movement of plunger 16 (to the left in FIG. 4). The angular arrangement of the individual toggle levers 86 relative to the pivotal fork 69 is shown in FIG. 6.

The removal of an empty shuttle 3 from the weaving process to discharge box 114, the insertion of the shuttle 33 prepared at the particular station into the weaving process by slide 16, the movement of winding 12 into the position of readiness 12*a*, the sliding of the empty shuttle 3 over the winding 12*a* on blade 11 of the winding mechanism of the particular station by pusher 64 as well as the production of a new winding 12 are here again subject to a synchronous movement sequence corresponding to the speed of the weaving process and as a function of the repeat pattern.

In connection with these processes control members cooperate in a manner to be described in greater detail hereinafter with the pin 63 or with the winding mechanisms of the individual stations. The control members are in operative connection with the main shaft of the machine and with a programme control device. The control members can be seen clearly in FIGS. 4 and 5.

An operating lever 90 is used for bringing about the synchronous movement of slide 16 at the particular station 51 to 54 with the operating speed of the corrugated shed loom and therefore synchronously with the rotary movement of the main shaft 26 of the machine. Operating lever 90 is on one side pivotable about a shaft 91 and with its free end strikes the scanning head 81 of plunger 80 in order to periodically press down plunger 80 under the action of cam 45 on shaft 26. As a result fork 69 constantly moves up and down at the speed of the machine, while simultaneously actuating the slide of the particular station with which discharge box 114 happens to be aligned (FIGS. 3 and 6).

With a time displacement relative to the movement of fork 69, pusher 64 is moved up and down in discharge box 114 for which purpose a second operating lever 92 (FIG. 5) is pivotably mounted on shaft 91 which with its free end strikes the scanning head 67 of plunger 66 carrying pusher 64 in order to periodically press down pusher 64 under the action of cam 25 on shaft 26.

Figure 5:
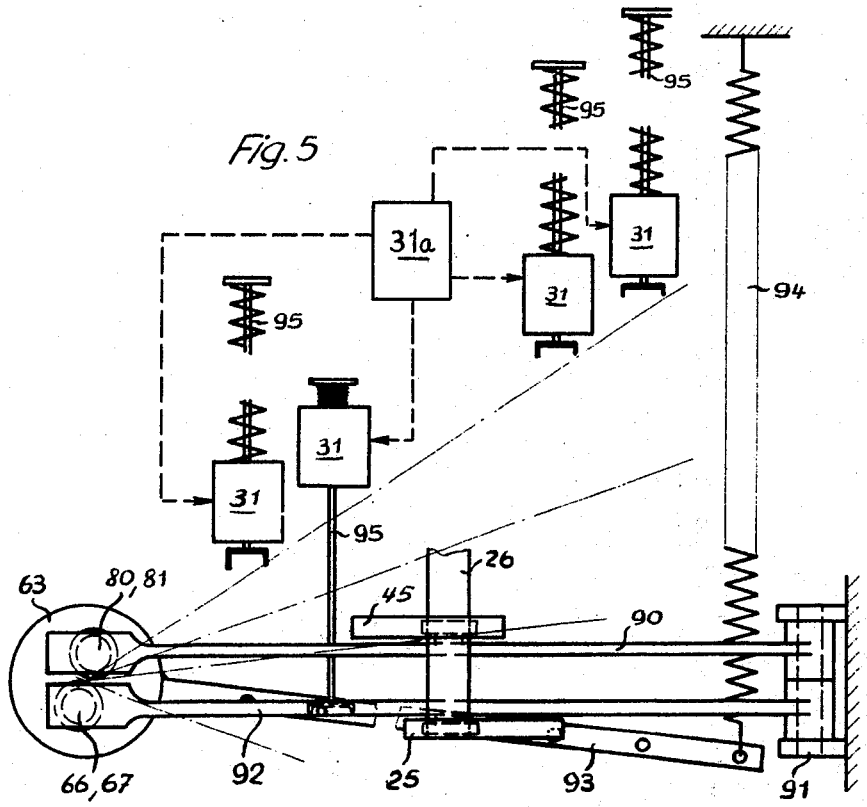
FIG. 5 shows a plan view of the arrangement illustrated in FIG. 4.

For the performance of the rotary movement of pin 63 and consequently a pivotal movement of discharge box 114 from its shuttle reception position into a position over a selected station 51 to 54 and back, accompanied by the simultaneously concomitant movement of fork 69, a control rod 93 is fixed to pin 63 which is under the action of a tension spring 94 which loads pin 63 in a counter-clockwise direction (FIG. 5). In this case four piston rods 95 controlled by magnets 31 engage on control rod 93, whereby each of the piston rods is in a position to adjust the control rod 93 and therefore pin 63 by an angle defined by the position of the particular station. Here again the magnets 31 receive their signals in a previously described manner by the programme control device 31*a*.

For the explanation of the operation of the above-described embodiment of the selection apparatus an operating phase is once again assumed in which a shuttle 33 with a weft winding therein is in readiness on each blade 11 of each station, whereby each blade once again carries a ready reserve winding 12, each rotor is stationary due to its open clutch 13 and all the piston rods 95 are disengaged relative to control rod 93 on pin 63. In this phase discharge box 114 is in the reception position for a conveyed empty shuttle shown by dotted lines in FIG. 3.

At approximately the same time as a shuttle enters discharge box 114 the programme control device 31*a*, corresponding to a predetermined programmed repeat pattern supplies a signal to one of the control magnets 31, which is for example associated with station 53. This control magnet 31 then brings its piston rod 95 into engagement with control rod 93 and pivots the discharge box 114 with the shuttle therein over the blade 11 of the particular station. Simultaneously the particular toggle lever 86 of rod 85 for slide 16 of the particular station is brought into engagement with fork 69.

As a result of the corresponding constructions of cams 25 and 45 plungers 66 and 80 are moved downwards at the speed of the machine but with a corresponding phase displacement in such a way that slide 16 initially displaces shuttle 33 from blade 11 and then pusher 64 mounts the empty shuttle 3 on blade 11. Between these two phases it is naturally necessary for the winding mechanism 106 to have at least moved reserve winding 12 forwards into the position of readiness 12*a* in order to then produce a new reserve winding 12. For this process the electromagnetic clutch 13 of the winding mechanism can again receive a signal from the programme control device 31*a* or the slide 16 can, in its displacement path, close a contact in the exciter circuit for the electromagnetic coupling 13. As all these processes take place very rapidly the pusher 64 can perform its movement substantially without any time lag and the carried-along empty shuttle 3 can be slid thereby onto the already advanced winding 12*a*. Then all the members participating in the above-described process can return to their initial position in a sequential movement, whereby there is once again a shuttle 33 with a winding in a position of readiness on blade 11 of station 53, so that if this is required by the repeat pattern the same station can be immediately selected again.

There has been described hereinbefore two exemplified embodiments of apparatus for selecting shuttles with weft windings of different yarn types for a preprogrammed weft insertion on a corrugated shed loom, which with relatively simple means permit a multi-type operation in the weft. It will be appreciated that a large number of modifications are possible within the scope of the invention. The essential point is that there is no need for a multi-storage of shuttles with windings of the same yarn type due to the direct exchange of an empty shuttle participating in the weaving process by a shuttle carrying a winding.

Other embodiments of the invention embodying the same or equivalent principles may be used and structural changes may be made as desired by those skilled in the art without departing from the present invention and the scope of the appended claims.

What is claimed is:

1. An apparatus for selecting shuttles with weft windings of different yarn types for a programmed weft insertion on a travelling wave loom, wherein empty shuttles removed from the weaving process receive their weft thread winding through a winding mechanism, wherein the apparatus comprises a plurality of stations arranged in the zone of weft insertion of the travelling wave loom, each station having one winding mechanism and wherein at each station actuating members are operatively connected to a programme control device for the selective insertion into the weaving process of one of the shuttles prepared on the winding mechanism of one of the stations and for the at least approximately simultaneous removal of an empty shuttle from the path of the shuttles and supplying it to the particular winding mechanism.

2. The apparatus according to claim 1 in which the empty shuttles on removal from the weaving process are received by a discharge box and are transferred by the discharge box to the winding mechanism, wherein at least approximately simultaneously a slide introduces into the weaving process the shuttle prepared on the particular winding mechanism.

3. The apparatus according to claim 2 in which after removing the prepared shuttle from a winding apparatus by the slide and prior to the transfer of the empty shuttle by the discharge box to the winding mechanism, the winding mechanism conveys a new winding into the transfer area of the winding mechanism for the transfer of the said winding to the empty shuttle.

4. The apparatus according to claim 1 wherein each winding mechanism comprises a rotor connectable to a drive source by an electromagnetic clutch which produces a weft winding on a blade, wherein the said winding can be moved into a transfer position on the blade where it is taken over by the empty shuttle and represents the position of insertion readiness of this shuttle.

5. The apparatus according to claim 1 in which the stations are arranged in series relative to the direction of movement of the shuttle into the shed, prior to the point of insertion of the shuttle into said shed.

6. The apparatus according to claim 5 in which the control members comprise machine-controlled connecting rods, whereof in each case two can be brought into operative connection with a discharge box at each station or with a slide of the particular station by means of control means operatively controllable by the programme control device.

7. The apparatus according to claim 1 in which the stations are juxtaposed in star-like manner relative to the insertion zone of the shuttle into the shed and in front of the insertion zone.

8. The apparatus according to claim 7 in which a removal point for the empty shuttles from shed of the weaving process is located adjacent to the stations in a pivoting zone common to all the stations relative to a fulcrum.

9. The apparatus according to claim 8 in which the fulcrum is formed by a swivellable shaft carrying a discharge box positionable common to all the stations.

10. The apparatus according to claim 9 in which said control members controllable by the programme control device engage on the swivellable shaft for swivelling the discharge box from the removal position to the winding mechanism of the selected stations.

11. The apparatus according to claim 3 in which the control members comprise machine-controlled plungers for operating a pusher on the discharge box and the slide provided at each station.

12. The apparatus according to claim 11 in which the stations are juxtaposed in star-like manner relative to the insertion zone of the shuttle into the shed and in front of the insertion zone.

* * * * *